US005954905A

United States Patent [19]

Hung

[11] Patent Number: 5,954,905

[45] Date of Patent: Sep. 21, 1999

[54] METHOD OF APPLYING LAYER STRUCTURE ON HOST SURFACE MATERIAL

[76] Inventor: Fu-Tung Hung, No. 977, He Liao, Kung Chiang Village, Pei-Men Hsiang, Tainan Hsien, Taiwan

[21] Appl. No.: 09/069,529

[22] Filed: Apr. 29, 1998

Related U.S. Application Data

[63] Continuation-in-part of application No. 08/702,216, Aug. 23, 1996, abandoned.

[51] Int. Cl.[6] ..... B44C 1/165

[52] U.S. Cl. ..... 156/230; 156/239; 156/240; 156/277; 427/374.4; 427/375

[58] Field of Search ..... 156/277, 230, 156/239, 240; 428/914, 913, 203–205; 427/374.4, 375

*Primary Examiner*—Merrick Dixon
*Attorney, Agent, or Firm*—Rosenberg, Klein & Bilker

[57] ABSTRACT

A method of applying a layered structure on a host surface for hot-melt printing is provided. A print pattern layer is placed with a release layer and an upper cellophane sheet on a top surface of the print pattern layer, and a lower cellophane sheet on a bottom surface thereof. The print pattern layer is then seated on top of a host surface material and heat-pressed at a temperature within a temperature range of between 80° to 150° Celsius. Under those conditions, the upper cellophane sheet melts and permeates the print pattern layer to merge with the lower cellophane sheet and is attached onto the host surface material. After regenerative cooling, the release layer is able to be peeled off, forming a protective print pattern layer. The cellophane sheets are formed by applying synthetic resin directly onto the release layer, and by peeling off the release layer to form the upper cellophane sheet and the lower cellophane sheet.

1 Claim, 1 Drawing Sheet

METHOD OF APPLYING LAYER STRUCTURE ON HOST SURFACE MATERIAL

CROSS-REFERENCED TO RELATED APPLICATION

This is a Continuation-in-Part of U.S. patent application Ser. No. 08/702,216 filed at the U.S. Patent and Trademark Office on Aug. 23, 1996, now abandoned.

BACKGROUND OF THE INVENTION

1. Field of the Invention

This invention relates to a method of applying layer structure on host surface material as to simplify the process and time saving.

2. Background of the Invention

The inventor, in view of the conventional decorating process applies onto wood, PVC and ABS material existing a few shortcomings, therefore has derived an improved processing method, please refer to the above mentioned application, which sandwiching a print pattern layer with two cellophane sheets and overlaying a release layer on the top cellophane sheet which then overlaying on a host surface material. This material is then heat-pressed by a steel plate under a predetermined temperature range which melts the upper cellophane sheet and permeates through the print pattern layer and merges into the lower cellophane sheet as well as onto the host surface material.

However, the previous two thin films are formed by pre-coating synthetic resin on two thin tissue papers which consumes more time and cost in process, and the film requires a large space to store.

SUMMARY OF THE INVENTION

It is the primary object of the present invention to provide a method of applying layer structure on host surface material which applies the synthetic resin onto the release layer directly without utilizing the tissue paper to support thus the film can be rolled for storage purpose.

It is another object of the present invention to provide a method of layer structure on host surface material which simplifies the process and saves the cost.

DETAILED DESCRIPTION OF THE PREFERRED EMBODIMENT

Figure 1:
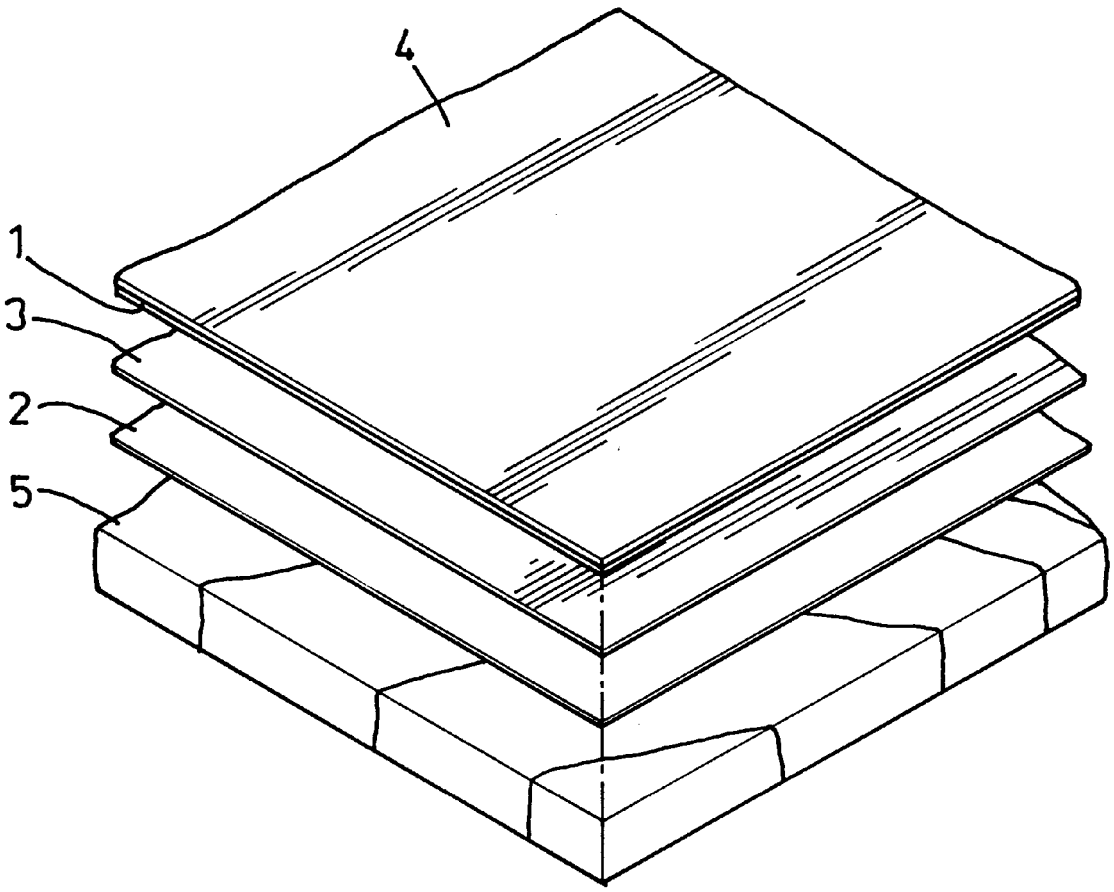
FIG. 1 is an exploded view of the present invention.

A film structure for hot-melting printing on host surface material, as shown in FIG. 1, comprises an upper cellophane sheet 1, a lower cellophane sheet 2, a print pattern layer 3, a release layer 4 and a host surface material 5.

The cellophane sheets 1 and 2 are formed by applying a synthetic resin onto the release layer 4 directly and melting formed thereon. The release layer 4 having formed with the upper cellophane sheet 1 is placed on top of the print pattern layer 3. The lower cellophane sheet 2 placed at the lower side of the print pattern layer 3 is the sheet stripped off from the release layer 4.

The release layer 4 with the upper cellophane sheet 1, the print pattern layer 3 and the lower cellophane sheet 2 are then placed on the host surface material 5 in sequence and then heat-pressed by a steel plate(not shown in the Figure) under the temperature ranging between 80° to 150° Celsius. The upper cellophane sheet 1 and the lower cellophane sheet 2 are melted and permeated through the print pattern layer 3 and onto the host surface material 5. Upon the two cellophane sheets 1 and 2 are cooling down, a hard transparent protective film will be formed and attached onto the host surface material 5 firmly. The release layer 4, at this moment can be peered off, and the process is completed.

The improvements of this invention has the followings 1. the cellophane sheets do not use tissue paper and therefore the process saves cost and time;

2. the cellophane sheet is formed directly onto the release layer which minimizes the process of continuous laying over steps, thus saving times.

I claim:

1. A method of applying a film structure for hot melt printing on a host surface, comprising the steps of:

a. forming a first cellophane sheet on a first release layer, said first cellophane sheet being formed by application of a synthetic resin directly to said first release layer and heating said synthetic resin;

b. forming a second cellophane sheet on a second release layer, said second cellophane sheet being formed by application of said synthetic resin directly to said second release layer and heating said synthetic resin;

c. removing said second release layer and applying said second cellophane sheet to the host surface;

d. providing a print pattern layer and applying said print pattern layer in overlaying relationship to said second cellophane layer;

e. applying said first cellophane sheet in overlaying relationship to said print pattern layer to form a multi layer structure;

f. pressing said multilayer structure to the host surface at an elevated temperature, said elevated temperature being within the approximating range of 80°–150° Celsius, said first and second cellophane sheets being melted to permeate into said print pattern layer and onto the host surface;

g. cooling said pressed multilayer structure to form a hard transparent protective film for said print pattern layer and adhering said print pattern layer to the host surface; and, h. removing said first release layer.

* * * * *